US009953760B2

(12) United States Patent
Bormann et al.

(10) Patent No.: US 9,953,760 B2
(45) Date of Patent: Apr. 24, 2018

(54) TRANSFORMER ARRANGEMENT FOR MITIGATING TRANSIENT VOLTAGE OSCILLATIONS

(71) Applicant: ABB Research Ltd., Zurich (CH)

(72) Inventors: Dierk Bormann, Västerås (SE); Lars Liljestrand, Västerås (SE); Martin Carlen, Niederrohrdorf (CH); Thorsten Steinmetz, Baden-Dättwil (CH); Philipp Buttgenbach, Kröpelin-Diedrichshagen (DE); Jens Tepper, Brilon (DE)

(73) Assignee: ABB Research Ltd., Zurich (CH)

( * ) Notice: Subject to any disclaimer, the term of this patent is extended or adjusted under 35 U.S.C. 154(b) by 380 days.

(21) Appl. No.: 14/652,692

(22) PCT Filed: Nov. 19, 2013

(86) PCT No.: PCT/EP2013/074165
§ 371 (c)(1),
(2) Date: Jun. 16, 2015

(87) PCT Pub. No.: WO2014/095206
PCT Pub. Date: Jun. 26, 2014

(65) Prior Publication Data

US 2016/0189858 A1 Jun. 30, 2016

(30) Foreign Application Priority Data

Dec. 19, 2012 (EP) ..... 12198162

(51) Int. Cl.
*H01F 27/34* (2006.01)
*H01F 27/29* (2006.01)
*H01F 27/40* (2006.01)

(52) U.S. Cl.
CPC ..... *H01F 27/34* (2013.01); *H01F 27/29* (2013.01); *H01F 27/343* (2013.01); *H01F 27/40* (2013.01)

(58) Field of Classification Search
CPC ..... H01F 27/29; H01F 27/34; H01F 27/343; H01F 27/40
(Continued)

(56) References Cited

U.S. PATENT DOCUMENTS 3,083,331 A * 3/1963 Spurway ..... H01F 29/02 323/340
5,005,100 A 4/1991 Owen
(Continued)

FOREIGN PATENT DOCUMENTS

EP 0078985 A1 5/1983
EP 0187983 A1 7/1986
EP 2747098 A1 6/2014

OTHER PUBLICATIONS

European Search Report Application No. EP 12 19 8162 Completed: May 10, 2013; dated May 21, 2013 4 pages.
(Continued)

*Primary Examiner* — Thienvu Tran
*Assistant Examiner* — Kevin J Comber
(74) *Attorney, Agent, or Firm* — Whitmyer IP Group LLC

(57) ABSTRACT

A transformer arrangement and transformer for mitigating transient voltage oscillations. The transformer included a transformer core enclosing at least one core leg. A winding is wound around one of the at least one core leg. The winding extends from a first winding terminal to a second winding terminal and includes a first winding section along a first conductor extending from the first winding terminal to a first intermediate end point, and a second winding section along a second conductor extending from a second interme-
(Continued)

diate end point to the second winding terminal. The transformer arrangement further includes an external passive electric component connected between the first intermediate end point and either the second intermediate end point or the second winding terminal arranged to decrease an effective difference between capacitive and inductive voltage distributions between the intermediate end points such that transient voltage oscillations in the winding are mitigated.

15 Claims, 5 Drawing Sheets

(58) Field of Classification Search
USPC ..... 361/270
See application file for complete search history.

(56) References Cited

U.S. PATENT DOCUMENTS

2011/0128013 A1* 6/2011 Werle ..... G01R 31/021
324/543
2011/0188167 A1* 8/2011 True ..... H01F 27/29
361/269

OTHER PUBLICATIONS

International Preliminary Report of Patentability Application No. PCT/EP2013/074165 dated Jan. 7, 2015 16 pages.
International Search Report and Written Opinion of the International Searching Authority Application No. PCT/EP2013/074165 Completed: Dec. 13, 2013; dated Jan. 2, 2014 10 pages.

* cited by examiner

TRANSFORMER ARRANGEMENT FOR MITIGATING TRANSIENT VOLTAGE OSCILLATIONS

TECHNICAL FIELD

Embodiments presented herein relate to a transformer arrangement, and in particular to a transformer arrangement for mitigating transient voltage oscillations.

BACKGROUND

In general terms, a transformer is a power converter that transfers alternating current (AC) electrical energy through inductive coupling between circuits of the transformer's windings.

Dry-type transformers are typically used for voltages up to 36 kV. They are mostly equipped with off-load tap changers allowing to set five different voltage ratios and a range of +/−5%. On-load tap changers are rarely used with dry-type transformers. Currently the application range of dry type transformer designs is being extended, involving a significant increase of their voltage rating. At this voltage levels most applications require the use of an on-load tap changer (OLTC) with much larger regulation range (+/−20%) and number of steps, as well as a corresponding extended regulation winding.

In the oil and gas industry, electric motors are used to drive submersible pumps which are located down in an oil or gas well. Such a motor is typically energized through a transformer connected at the well site to a conventional power distribution network.

Dry-type transformers have been operated at low voltage levels and with a small regulation range; in this case the voltages related to the transient oscillations can easily be managed and require relatively small dielectric distances. However, with increasing voltage and regulation range, the insulation distances grow and larger and larger dimensions are required also for the OLTC. Particularly, during impulse tests, transient oscillations are excited in the regulating winding of dry type transformers, which lead to high electric stresses on the OLTC. These stresses are particularly pronounced for a simple linear tap changer concept and when the OLTC is in the minimum position, so that the whole regulating winding is open (i.e., connected to the main winding at one end only).

U.S. Pat. No. 5,005,100 A discloses a transformer that comprises a primary winding and a secondary winding and that also includes a capacitor connected across at least a portion of the secondary winding within a housing of the transformer so that magnetically coupled voltage transients are filtered to prevent such transients from damaging a load connected to the secondary winding. An electrostatic shield is also included in the transformer to shield against capacitively coupled voltage transients. The capacitor is said also to improve the power factor.

EP 0 078 985 A1 relates to internal voltage grading and transient voltage protection for power transformer windings. A series string of plural zinc oxide varistor elements is electrically connected across each winding of a power transformer, with interior winding taps being electrically connected to the junctions between varistor elements. Each varistor string, disposed within the transformer casing, protects its associated winding from voltage surges in the same manner as externally mounted lightning arresters, provides highly effective voltage grading, and suppresses harmful transient voltage oscillations between the winding taps.

EP 0 187 983 A1 relates to a filter circuit including ZnO overvoltage arresters. A filter circuit with zinc oxide surge diverters for protection against transient interference and surges is connected in an alternating voltage network.

Hence, there is still a need for an improved transformer arrangement for mitigating transient voltage oscillations.

SUMMARY

An object of embodiments herein is to provide improved transformer arrangement for mitigating transient voltage oscillations.

According to a first aspect there is presented a transformer arrangement for mitigating transient voltage oscillations, comprising: a transformer, the transformer comprising: a transformer core comprising at least one core leg; and a winding wound around one of the at least one core leg, the winding extending from a first winding terminal to a second winding terminal and comprising a first winding section along a first conductor extending from the first winding terminal to a first intermediate end point, and a second winding section along a second conductor extending from a second intermediate end point to the second winding terminal. The transformer arrangement further comprises an external passive electric component connected between the first intermediate end point and either the second intermediate end point or the second winding terminal arranged to decrease an effective difference between capacitive and inductive voltage distributions between the intermediate end points such that transient voltage oscillations in the winding are mitigated.

Advantageously, the behaviour of the transformer under normal operating conditions is not affected by the connected external passive electric component.

Advantageously, according to some embodiments the arrangement works equally well for impulse applied on either winding terminal.

Advantageously, according to some embodiments the surge capacitance of the transformer as a whole is not significantly affected.

According to one embodiment the external passive electric component is an external capacitor $C_{ext,1}$ connected to the winding between the first intermediate end point and the second intermediate end point. Advantageously, such an arrangement works equally well for impulse applied on either winding terminal. Advantageously, the needed voltage rating of the capacitors is significantly lower than the impulse magnitude (by a factor 0.20-0.3). Thereby a series connection of capacitors may be avoided.

According to one embodiment the external passive electric component is an external capacitor $C_{ext,2}$ connected to the winding between the first intermediate end point and the second winding terminal. Advantageously, the needed voltage rating of the capacitors is significantly lower than the impulse magnitude (by a factor 0.20-0.3). Thereby a series connection of capacitors may be avoided.

According to one embodiment the external passive electric component is an external varistor connected to the winding between the first intermediate end point and the second intermediate end point. Advantageously, such a transformer arrangement works equally well for impulse applied on either winding terminal.

According to one embodiment the transformer arrangement further comprises a plurality of tap changer contacts provided along the first conductor. Advantageously, connecting an external passive electric component presents no practical problems in such a transformer arrangement since all tap changer contacts are easily accessible from the outside of the transformer.

According to a second aspect there is presented a transformer arrangement for mitigating transient voltage oscillations, comprising: a transformer, the transformer comprising: a transformer core comprising at least one core leg; and a winding wound around one of the at least one core leg, the winding extending from a first winding terminal to a second winding terminal and comprising a first winding section along a first conductor extending from the first winding terminal to a first intermediate end point, and a second winding section along a second conductor extending from a second intermediate end point to the second winding terminal. The transformer arrangement further comprises an external capacitor $C_{ext,1}$ connected to the winding between the first intermediate end point and the second intermediate end point; or an external capacitor $C_{ext,2}$ connected to the winding between the first intermediate end point and the second winding terminal; or an external varistor connected to the winding between the first intermediate end point and the second intermediate end point.

Advantageously, the behaviour of the transformer under normal operating conditions is not affected by the connected one or more external capacitors or varistors.

Advantageously, the needed voltage rating of the capacitors is significantly lower than the impulse magnitude (by a factor 0.20-0.3). Thereby a series connection of capacitors may be avoided.

According to one embodiment the transformer of the first aspect and/or the second aspect is a dry transformer.

It is to be noted that any feature of the first and second aspects may be applied to any other aspect, wherever appropriate. Likewise, any advantage of the first aspect may equally apply to the second aspect, respectively, and vice versa. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The inventive concepts will now be described more fully hereinafter with reference to the accompanying drawings, in which certain embodiments of are shown. The inventive concepts may, however, be embodied in many different forms and should not be construed as limited to the embodiments set forth herein; rather, these embodiments are provided by way of example so that this disclosure will be thorough and complete, and will fully convey the scope of the inventive concepts to those skilled in the art. Like numbers refer to like elements throughout the description.

The inventive concepts present different ways to mitigate transient stresses in transformers by connecting an external element to the windings of a transformer as described in more detail with reference to the below disclosed embodiments. As a result thereof, the voltage difference between the (previously open) winding ends is reduced.

Figure 1:
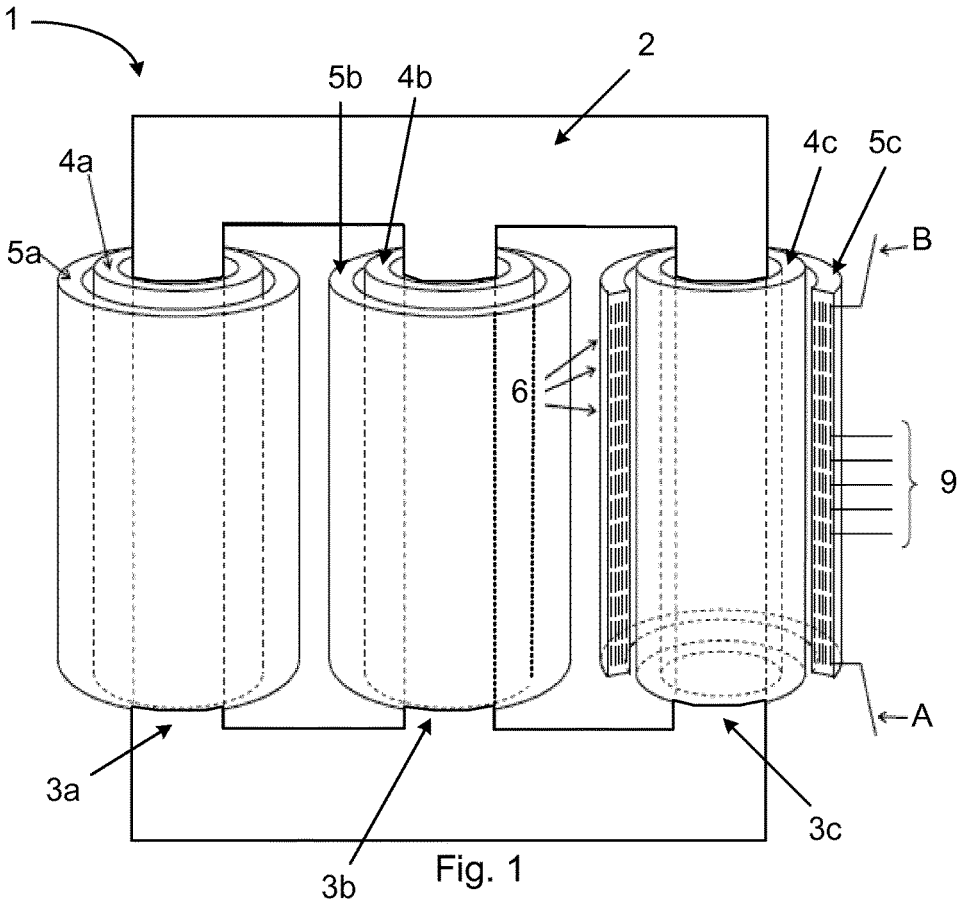
FIG. 1 is a schematic illustration (partly as a cross-section view) of a transformer arrangement according to embodiments.

FIG. 1 schematically illustrates a possible winding geometry of a transformer arrangement 1 according to embodiments. The transformer arrangement 1 comprises a transformer. The transformer comprises a transformer core 2. The transformer core 2 comprises at least one core leg. According to the embodiment illustrated in FIG. 1 the transformer core 2 comprises three core legs 3*a*, 3*b*, 3*c*. As the skilled person understands the disclosed embodiments are not limited to any particular number of core legs. A winding 4*a*, 4*b*, 4*c*, 5*a*, 5*b*, 5*c* is wound around each one of the core legs 3*a*, 3*b*, 3*c*.

The winding extends from a first winding terminal A to a second winding terminal B. The winding comprises a first winding section. The first winding section is provided as a set of winding discs 6. The winding further comprises a second winding section. The second winding section is provided as a set of winding discs 6. As the skilled person understands, the total numbers of winding discs 6 or sections and of regulating-winding taps may vary depending on the actual implementation and environment of the transformer arrangement 1.

The winding may be denoted a first winding. According to some embodiments the transformer arrangement further comprises a second winding. According to embodiments the second winding is wound between the first winding and the one core leg. The first winding may represent a primary high voltage, HV, winding and the second winding represents a secondary low voltage, LV, winding. Hence, according to one embodiment a secondary low voltage (LV) winding 4*a*, 4*b*, 4*c* is wound around each one of the core legs 3*a*, 3*b*, 3*c* and a primary high voltage (HV) winding 5*a*, 5*b*, 5*c* is wound around each LV winding 4*a*, 4*b*, 4*c*.However, according to some embodiments also the first winding represents a LV winding. One such example is a transformer arrangement comprising a Δ-connected LV winding and a Y-connected LV winding. According to embodiments the second winding is wound along a circumference of the first winding. Further, as the skilled person understands, the transformer arrangement may comprise even further windings (LV as well as HV); the disclosed transformer arrangement is not limited to any type or number of windings in this respect.

As further disclosed below, for example with references to FIGS. 2, 5 and 9, the first winding section is provided along a first conductor 7 and the second winding section is provided along a second conductor 8. The first conductor extends from the first winding terminal A to a first intermediate end point C. The second conductor extends from a second intermediate end point D to the second winding terminal B.

The transformer arrangement 1 further comprises a plurality of tap changer contacts 9. The tap changer contacts 9 are provided along the first conductor 7. In general terms, a tap changer contact 9 is a connection point along a transformer winding that allows a certain number of turns (windings) to be selected. This provides a transformer with a variable turns ratio, thereby enabling voltage regulation of the output. The tap selection is made via a tap changer 10.

During operation of the transformer arrangement 1 the initial "capacitive" voltage distribution at least along the winding 5*a*, 5*b*, 5*c*, determined solely by its stray capacitances, is different from the "inductive", quasi-stationary distribution at later times, determined by the stray inductances. This difference leads to voltage oscillations during the dynamic transition between the two. The transformer arrangement 1 is arranged to mitigating such transient voltage oscillations. In order to do so the transformer arrangement 1 comprises an external passive electric component. The external passive electric component is dimensioned so as to decrease an effective difference between capacitive and inductive voltage distributions between the intermediate end points such that transient voltage oscillations in the winding are mitigated. As further disclosed below, for example with references to FIGS. 2 and 9, the external passive electric component may be connected between the first intermediate end point C and the second intermediate end point D. As further disclosed below, for example with references to FIG. 5, the external passive electric component may be connected between the first intermediate end point C and the second winding terminal B.

According to exemplary embodiments either an external capacitor is connected over the open part of the regulating winding, or an external capacitor is connected between the open end of the regulating winding and the terminal B at which the impulse is applied, or an external varistor is connected over the open part of the regulating winding. These embodiments will now be described in turn. The "open end" is herein defined as the conductor-less part extending between the first conductor and the second conductor, i.e. between the first intermediate end point C and the second intermediate end point D.

First Exemplary Embodiment:

According to one embodiment the external passive electric component is an external capacitor $C_{ext,1}$ connected to the winding 5*a*, 5*b*, 5*c* between the first intermediate end point C and the second intermediate end point D. This is illustrated in FIG. 2.

Connecting an external capacitor over the open part of the regulating winding increases the oscillation period (i.e. reduces the oscillation frequency) to such an extent that the impulse decays before the oscillation reaches its first maximum, thereby decreasing the effective difference between "capacitive" and "inductive" voltage distributions. This is illustrated in FIG. 3, see below.

Figure 2:
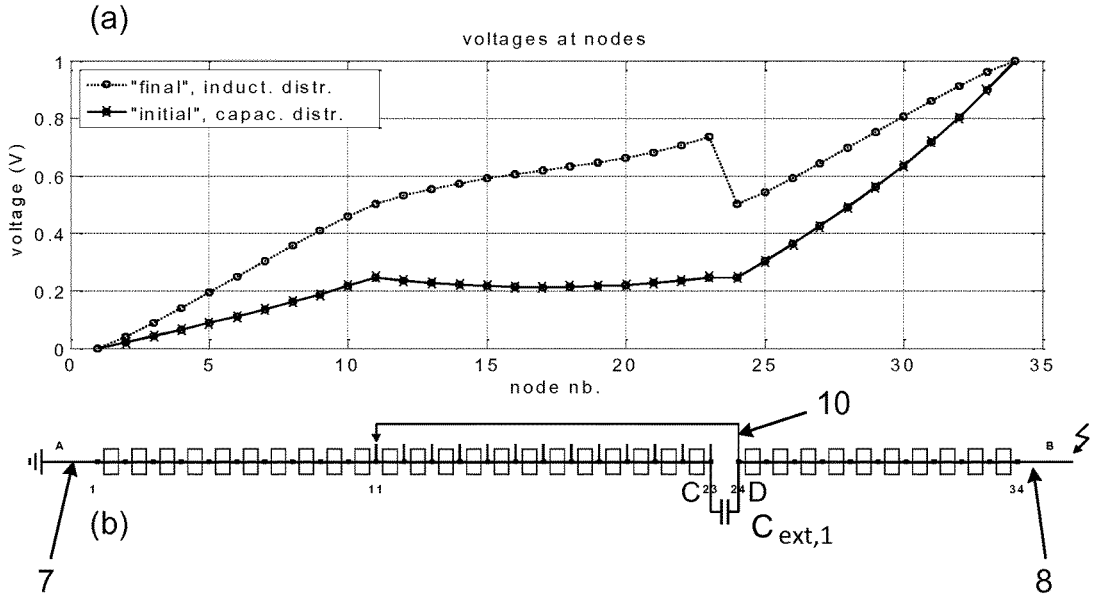
FIG. 2 schematically illustrates the final "inductive" and the initial "capacitive" impulse voltage distributions along the HV winding according to an embodiment.

The top part (a) of FIG. 2 shows the final "inductive" and the initial "capacitive" impulse voltage distributions along the winding for a unit impulse amplitude, obtained with a simulation model for a foil-disc winding of a 10 MVA transformer of VCC type for an impulse applied on winding terminal B. The bottom part (b) of FIG. 2 schematically illustrates a first conductor of the winding extending from a first winding terminal A to a first intermediate end point C and a second conductor of the winding extending from a second intermediate end point D to a second winding terminal B. In the bottom part (b) of FIG. 2, the winding sections or discs 6 of FIG. 1 are represented by rectangles. On the connections between subsequent discs lie the "nodes" of the model, indicated by dots, which are the points along the winding where the voltage was calculated with the simulation model for the result shown in the top part (a) of FIG. 2. In the bottom part (b) of FIG. 2 an external capacitor $C_{ext,1}$ is connected to the winding between nodes 23 and 24.

Figure 3:
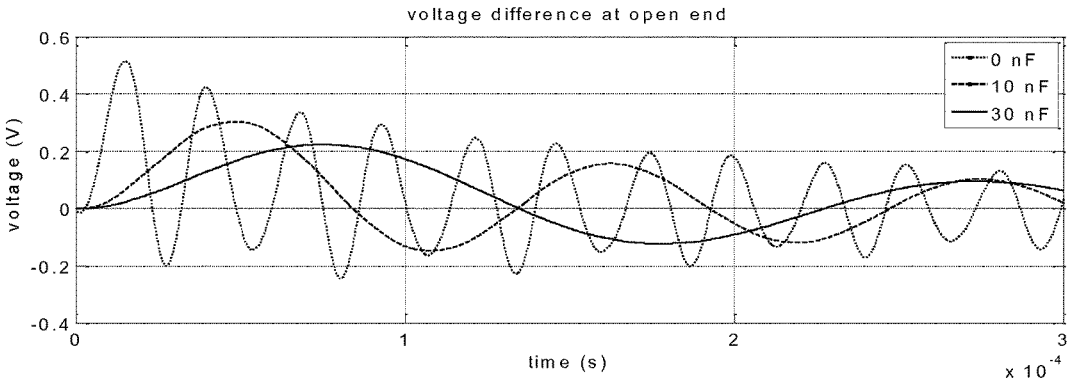
FIG. 3 schematically illustrates voltage as a function of time.

FIG. 3 schematically illustrates voltage difference between nodes 23 and 24 as a function of time (with 1.2-50 unit impulse on winding terminal B), for three different values of the external capacitance $C_{ext,1}$. In more detail, FIG. 3 shows the effect which the addition of different amounts of external capacitance ($C_{ext,1}$) has on the time-dependent voltage difference over the "open end" between node 23 at the first intermediate end point C (i.e., the open end of the regulating winding) and node 24 at the second intermediate end point D (i.e., the tap selector contact), calculated with the same model as used for the simulation results shown in FIG. 2.

According to an embodiment the capacitance value is in the range $C_{ext,1}$=5-100 nF. Preferably $C_{ext,1}$=5-10 nF. It is not expected It is not expected that the power and voltage ratings of the transformer will have a large impact on these values; in contrast, the voltage rating of the external capacitor $C_{ext,1}$ will increase with that of the transformer.

Figure 4:
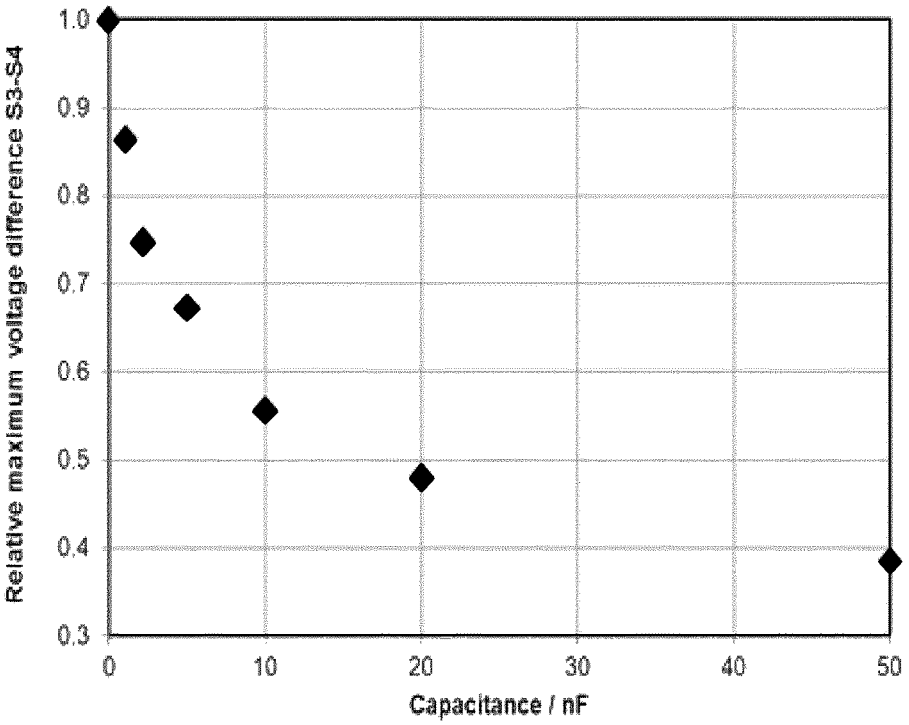
FIG. 4 shows the ratio of the maximum over-voltage over the "open end" for different capacitance values in FIG. 2.

FIG. 4 shows the ratio of the maximum over-voltage over the "open end" for different capacitance values. FIG. 4 shows results from measurements on a smaller transformer (24 kV / 900 kVA) of the same design type (VCC) as above. For these measurements, a winding arrangement with an "open end" similar to the one shown in FIG.2 is provided in one of the windings. To observe transient over-voltages over the gap, 33% of the total number of turns of the winding were bypassed by a galvanic tap changer. First the transient voltage over the "open end" was measured and its maximum was recorded as the reference value (the data point labelled "0 nF" in FIG. 3). Then, external capacitors, $C_{ext,1}$, with different capacitance values were connected over the "open end", and the transient voltages over the gap were measured in each case. FIG. 4 shows the ratio of the maximum voltage for each external capacitance value to the reference without external capacitance ("0 nF"). As can be seen, with high enough capacitance value a significant reduction of the maximum overvoltage was achieved. These results are consistent with the simulations on the 10 MVA design shown in FIG. 3.

Second Exemplary Embodiment:

According to one embodiment the external passive electric component is an external capacitor $C_{ext,2}$ connected to the winding between the first intermediate end point C and the second winding terminal B. This is illustrated in FIG. 5. According to a second embodiment an external capacitor is thus connected between the open end of the regulating winding and the second winding terminal B at which the impulse is applied.

The capacitance value, $C_{ext,2}$, is determined such that the voltage deviation between the "capacitive" and "inductive" distributions is minimized.

Figure 5:
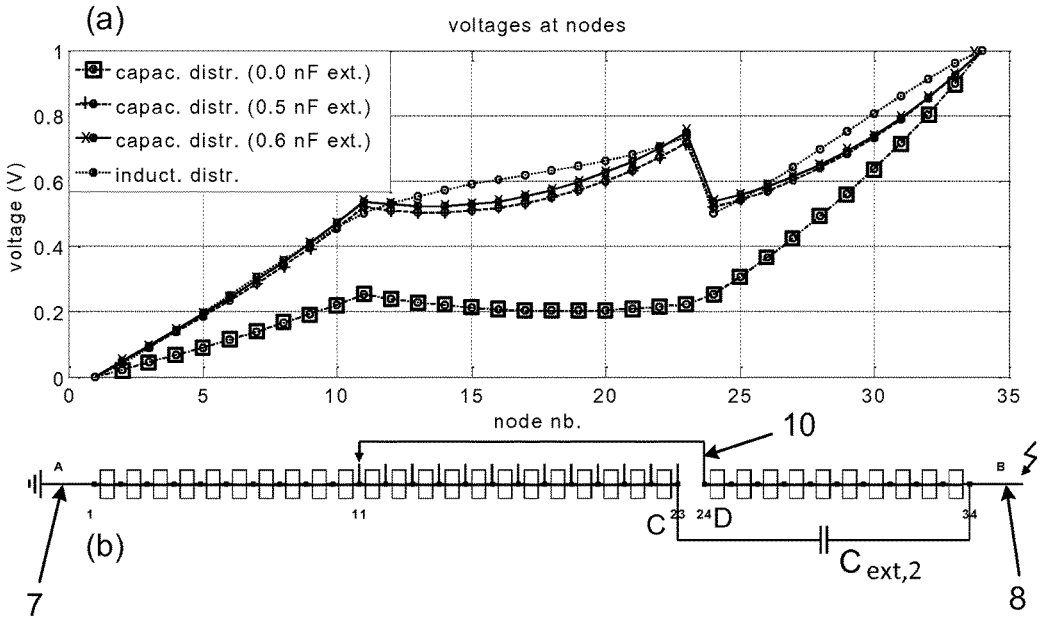
FIG. 5 schematically illustrates the final "inductive" and the initial "capacitive" impulse voltage distributions along the HV winding according to an embodiment.

The top part (a) of FIG. 5 shows the final "inductive" and the initial "capacitive" impulse voltage distributions along the winding for a unit impulse amplitude, obtained with a simulation model for a foil-disc winding of a 10 MVA transformer of VCC type for an impulse applied on winding terminal B, for two capacitance values $C_{ext,2}$=0.5 nF and $C_{ext,2}$=0.6 nF determined to be close to the optimum. The bottom part (b) of FIG. 5 schematically illustrates a first conductor of the winding extending from a first winding terminal A to a first intermediate end point C and a second conductor of the winding extending from a second intermediate end point D to a second winding terminal B. In the bottom part (b) of FIG. 5, winding sections or discs are represented by rectangles. On the connections between subsequent discs lie the "nodes" of the model, indicated by dots, which are the points along the winding where the voltage was calculated with the simulation model for the result shown in the top part (a) of FIG. 5. In the bottom part (b) of FIG. 5 an external capacitor $C_{ext,2}$ is connected to the winding between nodes 23 and 34.

Figure 6:
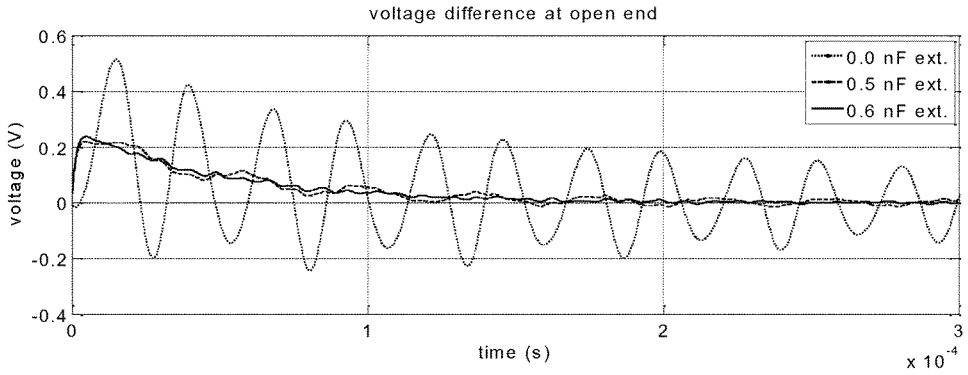
FIG. 6 schematically illustrates voltage as a function of time for the embodiment in FIG. 5.

FIG. 6 schematically illustrates voltage difference between nodes 23 and 34 as a function of time (with 1.2-50 unit impulse on winding terminal B), for three different values of the external capacitance $C_{ext,2}$. In more detail, FIG. 6 shows the effect of the external capacitances on the time-dependent voltage difference the "open end" between node 23 at the first intermediate end point C (i.e., the open end of the regulating winding) and node 34 at the second intermediate end point D (i.e., the tap selector contact), calculated with the same model.

The capacitance value should be well adjusted to the particular winding design (i.e., it must neither be too small nor too large) in order to achieve maximum benefit. According to an embodiment, the capacitance value is in the range $C_{ext,2}$=0.1-2.0 nF, preferably $C_{ext,2}$=0.1-1.0 nF, more preferably $C_{ext,2}$=0.5-0.6 nF. It is not expected that the power and voltage ratings have a very large impact on these values; in contrast, the voltage rating of the capacitor will increase with that of the transformer.

The needed capacitance value is quite low, but the voltage rating of the capacitor is of the same order as the impulse magnitude, so that in practice a series connection of capacitors may be used. According to an embodiment there is thus provided a series of capacitors $C_{ext,2}$ connected to the winding between the first intermediate end point C and the second winding terminal B. The necessary voltage rating of the capacitor (or capacitors in series) may be reduced by moving the regulating winding relative to the main winding, so that it lies electrically closer to winding terminal B.

The present configuration may only work when the impulse hits the windings from winding terminal B and not winding terminal A. Therefore, the present configuration may not be suitable in this form for Δ-connected phase windings; but it may be suitable for Y-connected windings with the neutral at terminal A.

For Δ-connected phase windings the present configuration may be modified by "pinning" the potential of the tap selector contact somewhere in the middle between the two terminal voltages through a capacitive voltage divider. According to an embodiment the transformer arrangement thus further comprises an external capacitive voltage divider connected to the first winding terminal A, the second intermediate end point D, and the second winding terminal B. This is illustrated in the bottom parts (b) of FIGS. 7 and 8.

Thus, the external capacitive voltage divider may comprise a capacitor $C_{ext,3}$ connected to the winding between the first winding terminal A and the second intermediate end point D and a capacitor $C_{ext,4}$ connected to the winding between the second intermediate end point D and the second winding terminal B. This embodiment thus requires three capacitors with full impulse voltage rating. Also, the surge capacitance of the winding may be significantly increased (ca. 500 pF instead of 120 pF without capacitors in the present example), which may be desirable in some applications and undesirable in others.

Figure 7:
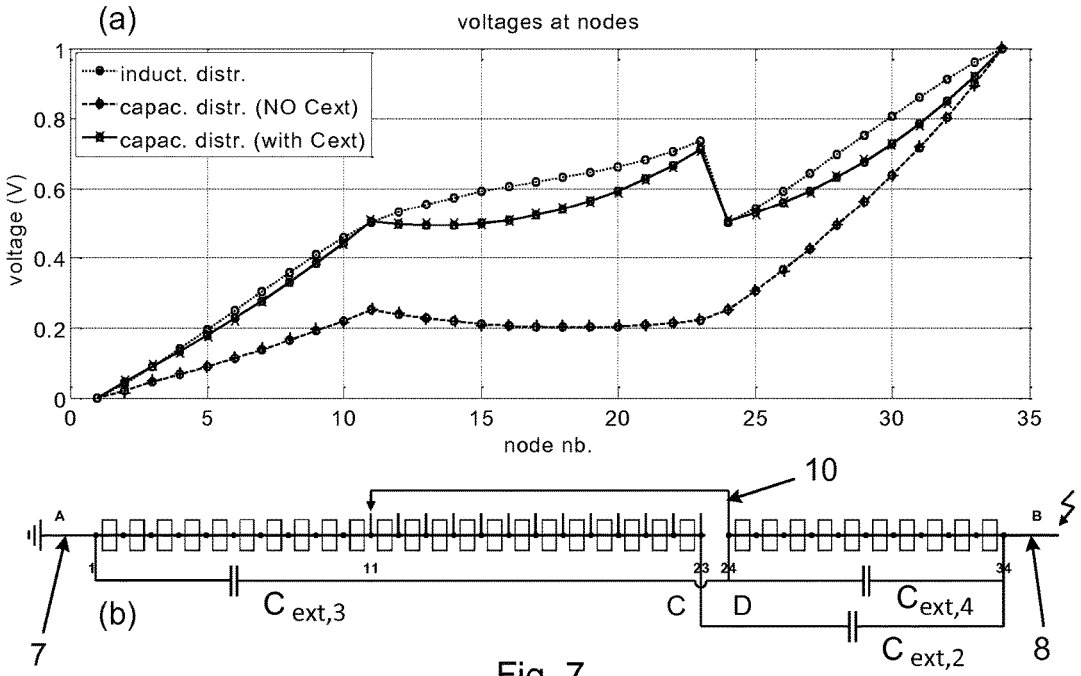
FIG. 7 schematically illustrates the final "inductive" and the initial "capacitive" impulse voltage distributions along the HV winding according to an embodiment.

The top part (a) of FIG. 7 shows the final "inductive" and the initial "capacitive" impulse voltage distributions along the winding for a unit impulse amplitude, obtained with a simulation model for a foil-disc winding of a 10 MVA transformer of VCC type for an impulse applied on winding terminal B, with and without external capacitors $C_{ext,2}$, $C_{ext,3}$ and $C_{ext,4}$. The bottom part (b) of FIG. 7 schematically illustrates a first conductor of the winding extending from a first winding terminal A to a first intermediate end point C and a second conductor of the winding extending from a second intermediate end point D to a second winding terminal B. In the bottom part (b) of FIG. 7, winding sections or discs are represented by rectangles. On the connections between subsequent discs lie the "nodes" of the model, indicated by dots, which are the points along the winding where the voltage was calculated with the simulation model for the result shown in the top part (a) of FIG. 7. In the bottom part (b) of FIG. 7 an external capacitor $C_{ext,2}$ is connected to the winding between nodes 23 and 34, an external capacitor $C_{ext,3}$ is connected to the winding between nodes 1 and 24, and an external capacitor $C_{ext,4}$ is connected to the winding between nodes 24 and 34.

Figure 8:
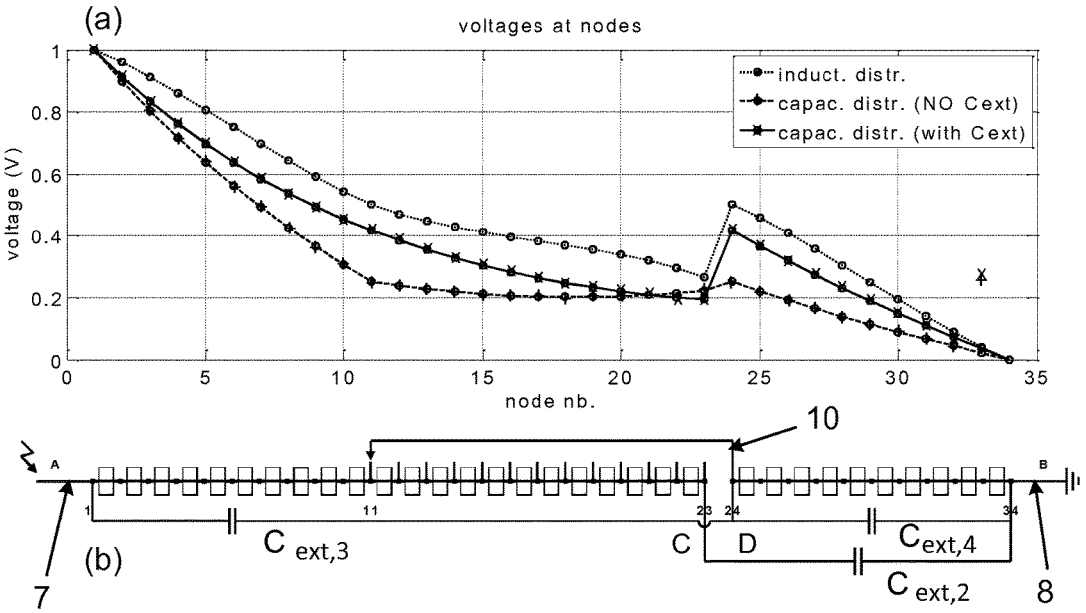
FIG. 8 schematically illustrates the final "inductive" and the initial "capacitive" impulse voltage distributions along the HV winding according to an embodiment.

The top part (a) of FIG. 8 shows the final "inductive" and the initial "capacitive" impulse voltage distributions along the winding for a unit impulse amplitude, obtained with a simulation model for a foil-disc winding of a 10 MVA transformer of VCC type for an impulse applied on winding terminal A, with and without external capacitors $C_{ext,2}$, $C_{ext,3}$ and $C_{ext,4}$. The bottom part (b) of FIG. 8 schematically illustrates a first conductor of the winding extending from a first winding terminal A to a first intermediate end point C and a second conductor of the winding extending from a second intermediate end point D to a second winding terminal B. In the bottom part (b) of FIG. 8, winding sections or discs are represented by rectangles. On the connections between subsequent discs lie the "nodes" of the model, indicated by dots, which are the point along the winding where the voltage was calculated with the simulation model for the result shown in the top part (a) of FIG. 8. In the bottom part (b) of FIG. 8 an external capacitor $C_{ext,2}$ is connected to the winding between nodes 23 and 34, an external capacitor $C_{ext,3}$ is connected to the winding between nodes 1 and 24, and an external capacitor $C_{ext,4}$ is connected to the winding between nodes 24 and 34.

The capacitance value for Δ-connected phase windings is preferably in the range 0.1-2.0 nF. That is, according to embodiments $C_{ext,3}$=0.1-2.0 nF and $C_{ext,4}$=0.1-2.0 nF, and preferably $C_{ext,3}$=$C_{ext,4}$=1.0 nF. As above, the power and voltage ratings are not expected to have a very large impact on these values, whereas the voltage rating of the capacitor will increase with that of the transformer.

Third Exemplary Embodiment:

According to one embodiment the electronic component is an external varistor 11 connected to the winding between the first intermediate end point C and the second intermediate end point D. This is illustrated in FIG. 9. Connecting an external varistor 11 over the open part of the regulating winding effectively limits the oscillation amplitude to the varistor protection level.

Figure 9:
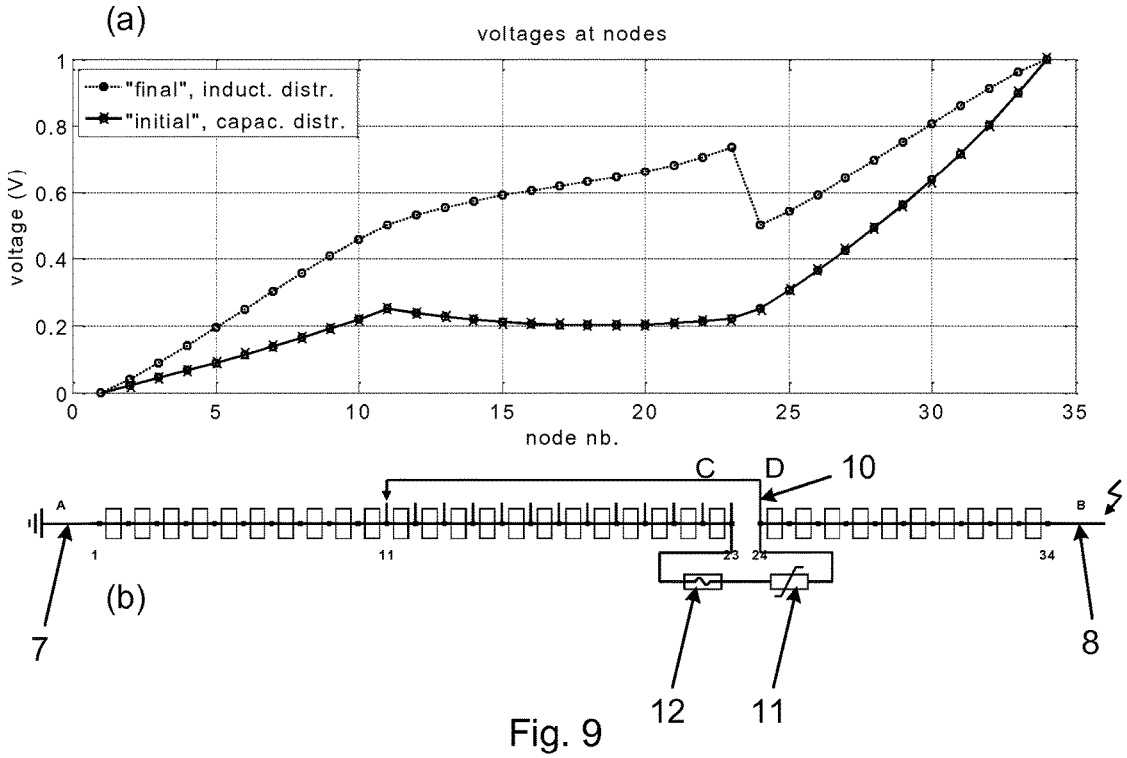
FIG. 9 schematically illustrates the final "inductive" and the initial "capacitive" impulse voltage distributions along the HV winding according to an embodiment.

The top part of FIG. 9 shows the final "inductive" distribution and the initial "capacitive" distribution for a unit impulse amplitude, obtained with a simulation model for the foil-disc winding of a 10 MVA unit of VCC type.

The top part (a) of FIG. 9 shows the final "inductive" and the initial "capacitive" impulse voltage distributions along the winding for a unit impulse amplitude, obtained with a simulation model for a foil-disc winding of a 10 MVA transformer of VCC type for an impulse applied on winding terminal B, with an external varistor 11 and an external fuse 12. The bottom part (b) of FIG. 9 schematically illustrates a first conductor of the winding extending from a first winding terminal A to a first intermediate end point C and a second conductor of the winding extending from a second intermediate end point D to a second winding terminal B. In the bottom part (b) of FIG. 9, winding sections or discs are represented by rectangles. On the connections between subsequent discs lie the "nodes" of the model, indicated by dots, which are the points along the winding where the voltage was calculated with the simulation model for the result shown in the top part (a) of FIG. 9. In the bottom part (b) of FIG. 5 an external varistor and an optional external fuse are connected in series to the winding between nodes 23 and 34.

Figure 10:
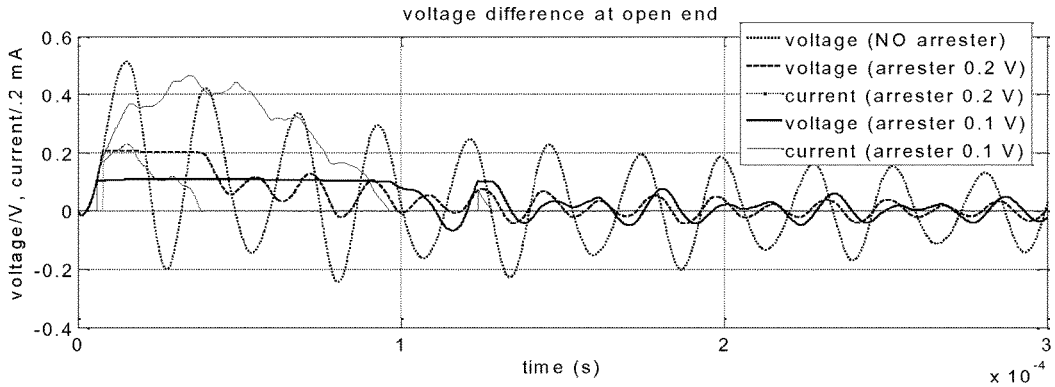
FIG. 10 schematically illustrates voltage and arrester current as a function of time for the embodiment in FIG. 9.

FIG. 10 schematically illustrates voltage difference between nodes 23 and 24 as a function of time (with 1.2-50 unit impulse on winding terminal B), for two different values of the external varistor 11. In more detail, FIG. 10 shows the effect which the addition of an external varistor has on the time-dependent voltage difference over the "open end" between node 23 at the first intermediate end point C (i.e., the open end of the regulating winding) and node 24 at the second intermediate end point D (i.e., the tap selector contact), calculated with the same model as used for the simulation results shown in FIG. 9.

The varistor protection level can be adjusted, for instance to the requirements of the tap changer. According to an embodiment the external varistor 11 has a protection level of 5-30% of the transformer basic insulation level, BIL.

The energy $W_{arr}$ dumped into the varistor is typically of the order of some Joule for 100 kV impulse magnitude. For example, for the 10 MVA VCC type transformer model used above the following is obtained:

$$W_{arr}=(5.9\ \text{J})(U_{imp}/100\ \text{kV})^2 \text{ for varistor protection level}=0.1\ U_{imp}, \text{ and}$$

$$W_{arr}=(1.7\ \text{J})(U_{imp}/100\ \text{kV})^2 \text{ for varistor protection level}=0.2\ U_{imp},$$

where $U_{imp}$ is the impulse voltage maximum.

According to embodiments an external fuse 12 is connected in series with the external varistor 11. A fuse 12 connected in series with the varistor 11 could protect the transformer in case of varistor breakdown. Its dimensioning is determined based on the expected "normal" varistor current under impulse conditions being low (below 10 A per 100 kV impulse magnitude in the present example, see FIG. 10). The varistor current during impulse is of the order of some Amps, i.e., much smaller than a short circuit current.

The invention has mainly been described above with reference to a few embodiments. However, as is readily appreciated by a person skilled in the art, other embodiments than the ones disclosed above are equally possible within the scope of the invention, as defined by the appended patent claims. For example, the embodiments are particularly suitable for dry transformers. According to embodiments the disclosed transformer is a dry transformer. Dry distribution transformers may be used to step down three-phase medium voltage to low voltage for power distribution. Such transformers are used primarily in metropolitan areas (public buildings, offices, distribution substations) and are also used in industrial applications. Dry type transformers are an ideal solution for applications where the transformers have to be installed near their place of use. Close installation saves on the installation outlay of cabling while at the same time reducing losses in cables and terminals on the low-voltage side. Dry type transformers are environmentally safe and suitable for indoor and outdoor applications. They provide excellent mechanical and short circuit strength, have no liquids to leak, and present no danger of fire or explosion. The transformers may or may not be provided with enclosures for extra added protection against harsh outdoor or indoor environments. They can be used in all types of applications including ground mount, primary and secondary substation units.

However, the embodiments presented herein are neither specific to dry-type transformers nor to a simple linear tap changer concept. The embodiments presented herein are also applicable to for oil-filled transformers and more complex tap changer concepts.

The invention claimed is:

1. A transformer arrangement for mitigating transient voltage oscillations, comprising:

a transformer, the transformer comprising:

a transformer core comprising at least one core leg; and a winding wound around each of the at least one core leg, the winding extending from a first winding terminal (A) to a second winding terminal (B) and comprising a first winding section along a first conductor extending from said first winding terminal (A) to a first intermediate end point (C), and a second winding section along a second conductor extending from a second intermediate end point (D) to said second winding terminal (B), wherein said first intermediate end point (C) and said second intermediate end point (D) are separated from each other;

an external passive electric component ($C_{ext,1}$, $C_{ext,2}$) connected between the first intermediate end point (C) and either the second intermediate end point (D) or said second winding terminal (B) and arranged to decrease an effective difference between capacitive and inductive voltage distributions between the intermediate end points such that transient voltage oscillations in the winding are mitigated;

a plurality of tap changer contacts provided along said first conductor; and a tap changer connectable to the winding at said second intermediate end point (D) and a point (E) along said first conductor at one of said plurality of tap changer contacts.

2. The transformer arrangement according to claim 1, wherein the external passive electric component is an external capacitor $C_{ext,1}$ connected to the winding between said first intermediate end point (C) and said second intermediate end point (D).

3. The transformer arrangement according to claim 2, wherein $C_{ext,1}$=5-100 nF.

4. The transformer arrangement according to claim 3, wherein $C_{ext,1}$=5-10 nF.

5. The transformer arrangement according to claim 1, wherein the external passive electric component is an external capacitor $C_{ext,2}$ connected to the winding between said first intermediate end point (C) and said second winding terminal (B).

6. The transformer arrangement according to claim 5, wherein $C_{ext,2}$=0.1-2.0 nF.

7. The transformer arrangement according to claim 5, further comprising:

an external capacitive voltage divider connected to said first winding terminal (A), said second intermediate end point (D), and said second winding terminal (B).

8. The transformer arrangement according to claim 7, wherein said external capacitive voltage divider comprises:

a capacitor $C_{ext,3}$ connected to the winding between said first winding terminal (A) and said second intermediate end point (D); and a capacitor $C_{ext,4}$ connected to the winding between said second intermediate end point (D) and said second winding terminal (B).

9. The transformer arrangement according to claim 8, wherein $C_{ext,3}$=0.1-2.0 nF and $C_{ext,4}$=0.1-2.0 nF.

10. The transformer arrangement according to claim 9, wherein $C_{ext,3}$=$C_{ext,4}$=1.0 nF.

11. The transformer arrangement according to claim 1, wherein the external passive electric component is an external varistor connected to the winding between said first intermediate end point (C) and said second intermediate end point (D).

12. The transformer arrangement according to claim 11, wherein the external varistor has a protection level of 5-30% of the transformer basic insulation level, BIL.

13. The transformer arrangement according to claim 11, further comprising:

an external fuse connected in series with the external varistor.

14. The transformer arrangement according to claim 1, wherein said winding is denoted a first winding, the transformer arrangement further comprising:

a second winding wound either between said first winding and said one core leg, or along a circumference of said first winding.

15. The transformer arrangement according to claim 1, wherein the transformer is a dry transformer.

* * * * *